United States Patent [19]

Pascoe, Sr.

[11] Patent Number: 4,576,611

[45] Date of Patent: Mar. 18, 1986

[54] METHOD FOR PRODUCING RANDOM-APPEARING PATTERNS ON FABRIC: NODES AND LINE SEGMENTS

[75] Inventor: William M. Pascoe, Sr., Inman, S.C.

[73] Assignee: Milliken Research Corporation, Spartanburg, S.C.

[21] Appl. No.: 615,988

[22] Filed: May 31, 1984

[51] Int. Cl.[4] ..... D06P 5/00

[52] U.S. Cl. ..... 8/482; 8/478; 8/532; 8/922; 8/927; 428/152

[58] Field of Search ..... 8/482

[56] References Cited

U.S. PATENT DOCUMENTS

| | | | |
|---|---|---|---|
| 1,170,981 | 2/1916 | McCarthy | 26/1 |
| 2,248,962 | 7/1941 | Cook | 57/1 R |
| 2,524,119 | 10/1950 | Van Heek | 8/130.1 |
| 2,695,653 | 11/1954 | Jones | 156/183 |
| 2,763,914 | 9/1956 | Wood | 28/163 |
| 2,823,092 | 2/1958 | Spencer | 8/482 |
| 2,851,206 | 9/1958 | Guenther et al. | 223/28 |
| 3,102,771 | 9/1963 | Neale | 8/482 |
| 3,925,863 | 12/1975 | Meyer | 26/1 |
| 4,108,595 | 8/1978 | Pappas | 8/482 |
| 4,444,101 | 4/1984 | Weiner et al. | 8/482 |

FOREIGN PATENT DOCUMENTS

| | | |
|---|---|---|
| 79429 | 5/1983 | European Pat. Off. . |
| 152374 | 11/1981 | German Democratic Rep. . |
| 293857 | 9/1929 | United Kingdom . |

*Primary Examiner*—A. Lionel Clingman

*Attorney, Agent, or Firm*—George M. Fisher; H. William Petry

[57] ABSTRACT

A method is disclosed for permanently patterning a textile fabric with a visually pleasing random-appearing network of line segments, as well as the fabrics produced thereby. The fabric is preferably calendered on at least one side, then packed into a heated chamber via a multi-stage folding or pleating process. The packed fabric is retained in the heated chamber a sufficient time to heat set the network of creases generated by the packing process. The fabric may then be dyed; creased portions of the fabric appear more saturated with dye.

13 Claims, 17 Drawing Figures

METHOD FOR PRODUCING RANDOM-APPEARING PATTERNS ON FABRIC: NODES AND LINE SEGMENTS

This invention relates to a method which may be used for permanently patterning a textile substrate with a visually pleasing dyed pattern which resembles a network of lines in a random-appearing "crackled" or "crazed" pattern, and to products produced thereby.

Printed or dyed textiles having a crackled or crazed pattern of dyed lines have enjoyed a long-standing popularity. The process described herein is capable of imparting a permanent, random appearing pattern to textile substrates somewhat similar to the pattern of creases found in crumpled paper, using an automated series of steps suitable for manufacturing commercial quantities of such substrates in a continuous, rather than a batch, production mode.

The selected textile substrate, preferably an undyed or upholstery weight flat or pile fabric constructed of synthetic materials, is preferably calendered on at least one side, or otherwise treated, to establish a smooth, hard finish to the fabric. The fabric is then fed through a pleating apparatus which imparts a series of parallel folds or pleats in the fabric extending across the width of the fabric, i.e., the pleat folds extend parallel to the direction of fabric feed. The pleated fabric is then stuffed or wadded into a heated chamber or stuffing box having a relatively small volume, via a system of pusher fingers which introduces folds extending in other directions. When tightly compacted within the chamber, the folds imparted to the fabric generate a network of interconnected creases having non-uniform lengths, orientations, and degrees of "crispness" or definition, so as to give the appearance that the creases are randomly oriented and of random length and degree of crispness. The creased, tightly packed mass of fabric is slowly transported through the chamber by the action of the pusher fingers. The residence time of the fabric and the temperature of the chamber are sufficient to heat set the creases in the packed mass of fabric and produce the desired results. This heat set step is used to prevent the creases in the fabric from being eliminated in subsequent dyeing and finishing operations, or in storage and use of the fabric. After exiting the chamber, the fabric may be stored and later dyed and finished using conventional dyeing and finishing techniques.

The resulting dyed product exhibits visually distinct dyed lines corresponding to the crease lines placed in the fabric prior to dyeing, thereby forming a visually pleasing pattern or network of lines which appear to be of random length, orientation, and definition, and which are seen against a contrasting background which has been dyed in the same process used to dye the network of lines. If a smooth, uncreased fabric surface is desired, the crushed, dyed fabric may be passed through a conventional tenter frame, for the purpose of simultaneously stretching and heating the fabric. Fabric which has been passed through this additional, optional step following dyeing may be made to exhibit the random-appearing network of dyed line segments, with few discernible creases associated with the line segments. By use of this step, a substantially unwrinkled fabric which also exhibits a random-appearing network of dyed line segments and which is fully capable of smooth draping, folding, or contouring may be made. Optionally, one may pass the fabric through a tenter frame or the like to remove some of the creases in the fabric prior to, rather than following, the dyeing and finishing operations. Such treatment generally results in a dyed network of line segments which is more subtle and exhibits less contrast than the pattern which results if the creases are left in place during the dyeing and finishing operations.

Details of the invention may be better understood by referring to the discussion below, together with the accompanying drawings, in which.

Figure 1:
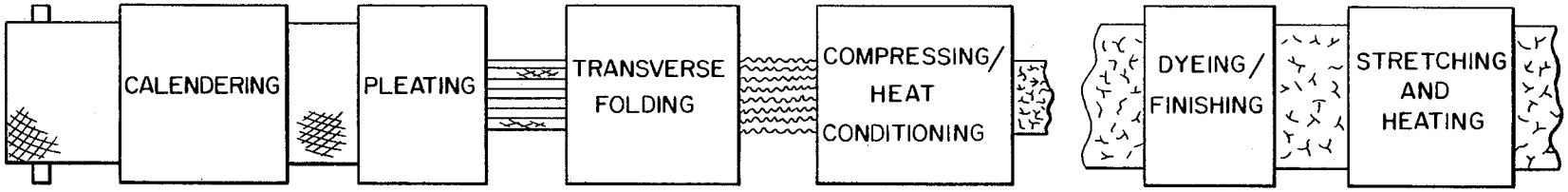
FIG. 1 is a block diagram depicting one embodiment of the invention disclosed herein.

FIG. 1 serves as a summary of one embodiment of the process of this invention. As depicted by the process blocks of FIG. 1, the fabric to be processed is first calendered under conditions sufficient to impart a relatively hard finish to at least one side of the fabric. This hard finish is helpful in permitting the fabric to crease where it is sharply folded, and to "seal" the fabric surface and retard dye penetration. The conditions under which such calendering is carried out may be varied depending upon the nature of the fabric and the degree of crease sharpness desired. In general, relatively high calendering pressures (e.g., calender roll forces up to about 80 tons) and temperatures (e.g., calender roll temperatures within the range of about 350° to about 425° F.) have been found preferable.

Figure 2:
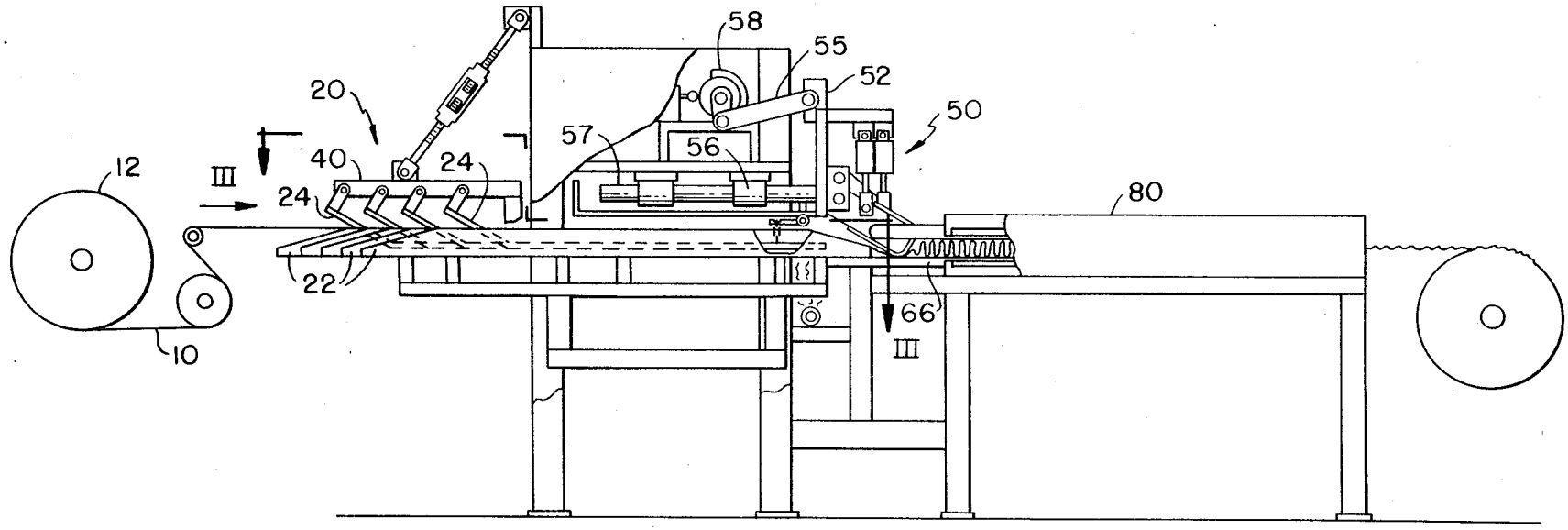
FIG. 2 is an overall elevation view of an apparatus which may be used in carrying out the invention.
Figure 3:
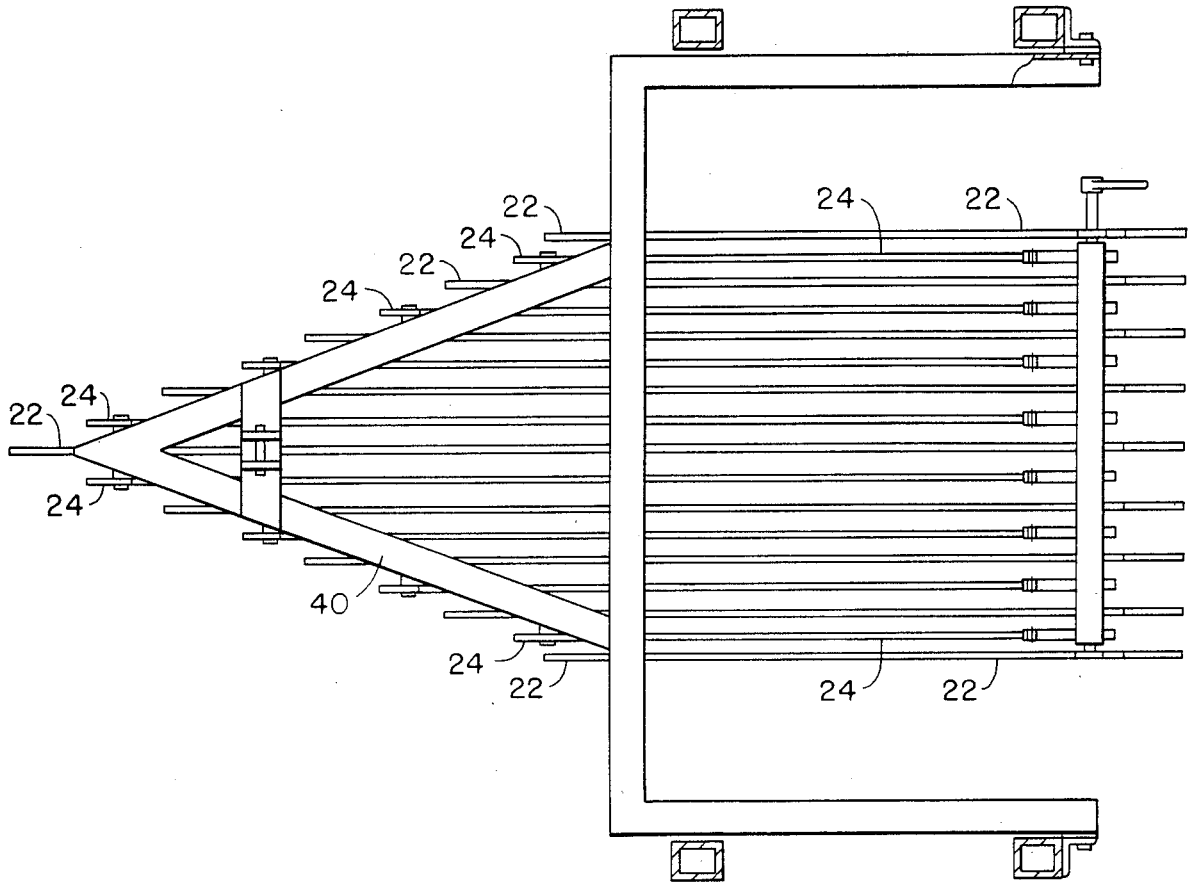
FIG. 3 is a section view, taken through lines III—III of FIG. 2, of a pleating means which may be used in carrying out this invention.
Figure 4:
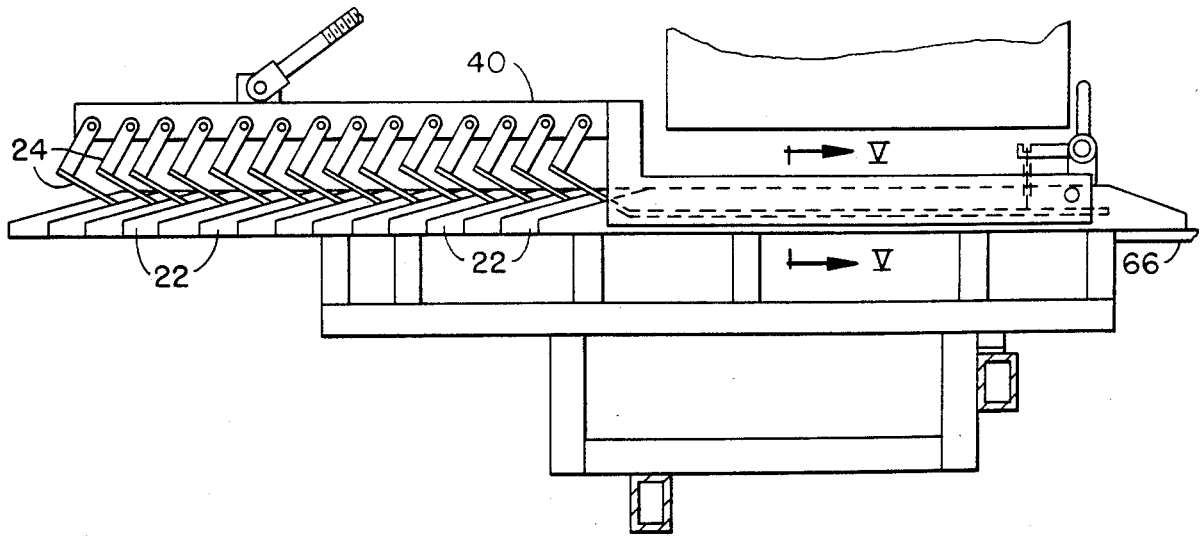
FIG. 4 is an elevation view of the pleating means of FIG. 3.
Figure 5:
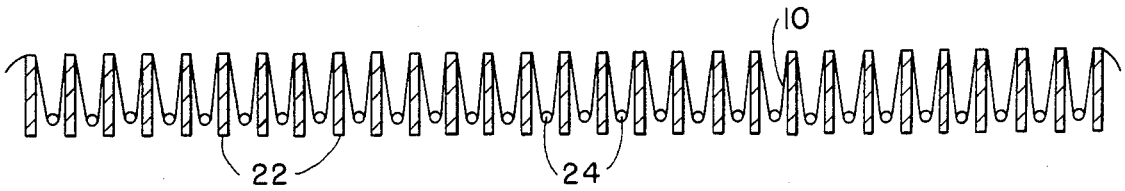
FIG. 5 is a section view of the pleating means of FIG. 4, taken along lines V—V, respectively.

FIG. 2 depicts apparatus which may be used to prepare previously calendered fabric for patterning in accordance with the teaching of this invention. Textile fabric 10 is fed from roll 12 into a pleating device, shown generally at 20. It is not necessary for fabric 10 to contain any appreciable amounts of moisture. The details of pleating device 20 are depicted in FIGS. 3 through 5. Pleating device 20 is comprised of thin, flat pleating slats 22, which are oriented lengthwise along the direction of fabric travel, and which are oriented widthwise in a substantially vertical direction. Associated with slats 22 is a set of pleating members or rods 24, extending from support member 40, which may be positioned between and parallel to slats 22 as depicted in FIGS. 4 and 5. Rods 24 are equidistantly spaced between adjacent pleating slats, thereby permitting fabric 10 to be threaded over the top of the slats and under adjacent rods 24 and forming the fabric into a series of parallel, uniform folds extending the length of the fabric lying within slats 22, with uniform undulations extending across the fabric. It should be understood that the exact nature of the pleating device 20 used in carrying out the invention disclosed herein is not important so long as the device or method used produces folds or pleats in the fabric, extending in the direction of fabric travel (e.g., in the warp direction), similar to the device disclosed hereinabove. Following passage of the fabric through pleating means 20, the fabric 10 carries undulating folds which extend in a direction parallel to the direction of fabric travel, but is not yet creased, and no significant heat has been applied to the folded fabric.

Figure 6:
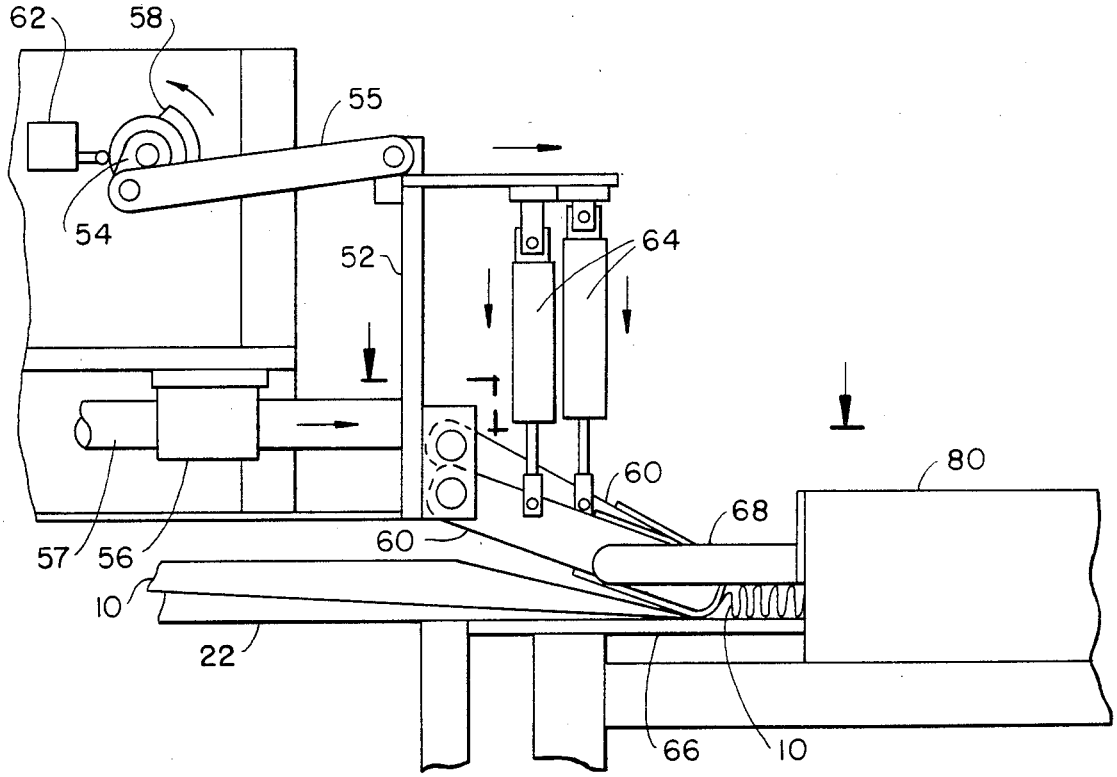
FIGS. 6 and 7 are elevation views of a feeding means which may be used in carrying out this invention shown in different positions in the course of feeding fabric into the heating chamber.
Figure 7:
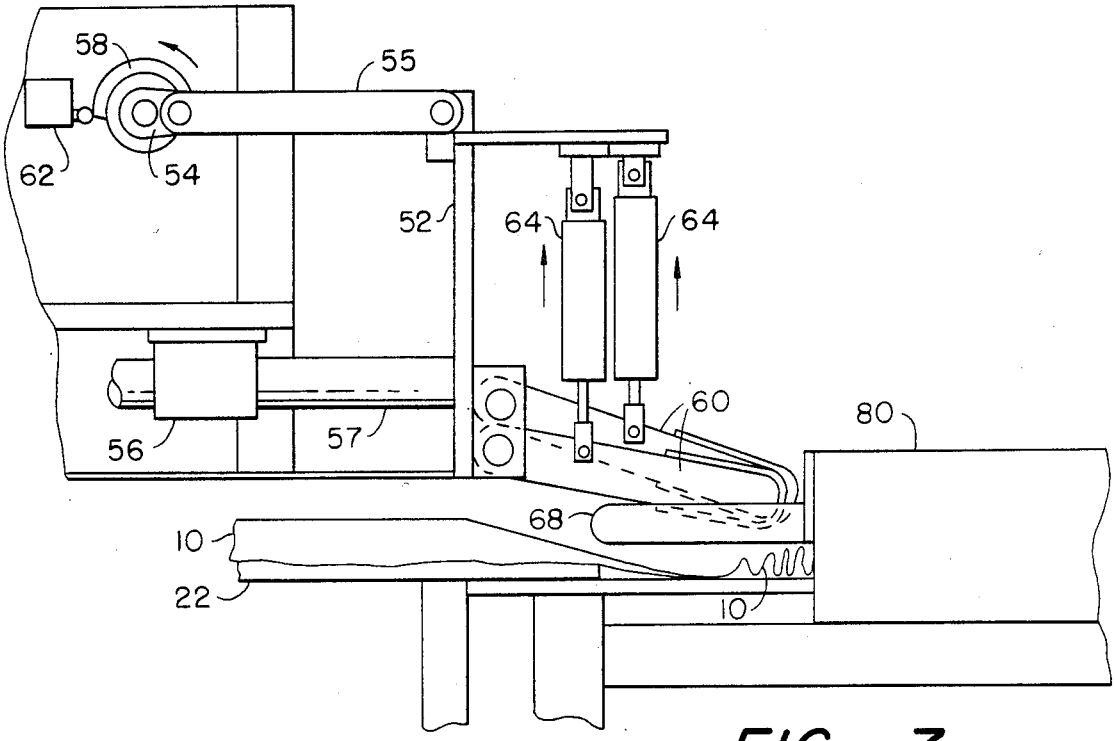
Figure 8:
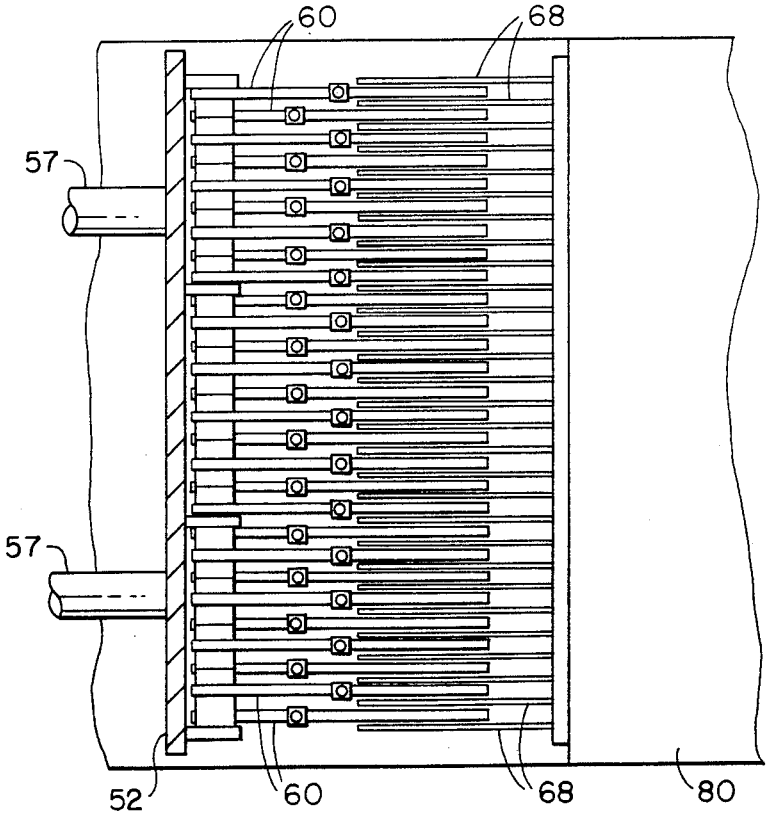
FIG. 8 is a section view of the feeding apparatus of FIG. 6, taken through lines VIII—VIII.

The folded fabric is then tightly packed into the confines of heated stuffing chamber 80 by feeding means shown generally at 50. As depicted in FIGS. 6–8, feeding means 50 is comprised of an array of parallel, aligned (see FIG. 8) pushing members 60 which are pivotally attached to reciprocating frame 52 so as to permit members 60 to be raised and lowered, by means of command-actuated cylinders 64, onto the surface of fabric 10 as it emerges from pleater 20. Frame 52 is driven horizontally, along the axis of fabric travel, in a reciprocating motion by the action of crank 54 and connecting rod 55, operating in conjunction with linear bearing 56 and shaft 57. Cylinders 64 are actuated by means of cam 58 acting on air supply switch 62. The resulting compound motion is depicted in FIGS. 6 and 7. The actuation of cylinders 64 may be adjusted to cause all pushing members 60 to act in a simultaneous, coordinated motion in pressing fabric 10 against bottom plate 66 and into the uniformly spaced channels formed by an array of vertically oriented pushing member guide slats 68 which lead into stuffing chamber 80, as shown in FIG. 6. This action imparts folds to the fabric which extend in transverse directions from those folds imparted by pleating means 20.

Slats 68 do not necessarily correspond with, nor are necessarily aligned with, pleating slats 22. Slats 68 serve not only to guide pushing members 60 as they are extended and retracted during the feeding cycle, but also serve to "catch" or retain folds imparted by pleating slats 22 as well as the folds imparted by pushing members 60, and allow members 60 to generate folds which appear to have a random orientation and character. The vertically offset mounting of adjacent members 60 depicted in FIGS. 6 and 7 is merely to allow for convenient close spacing the members 60 on frame 52; the different length of cylinders 64 associated with offset alternate members 60 compensates for the higher pivot associated with those alternate members. Cam 58 serves to actuate switch 62 which in turn causes cylinders 64 to raise pushing members 60 at the point of maximum throw of crank 54, and therefore the point of maximum extension of members 60 in the direction of chamber 80, and permits retraction of members 60 by way of the reciprocating action produced by crank 54 without pulling fabric 10 out of the entrance to chamber 80, as shown in FIG. 7. As members 60 reach the point of maximum retraction away from chamber 80, cam 58 causes switch 62 to actuate cylinders 64 and bring the ends of members 60 downward and into contact with fabric 10 in preparation for pushing another pleated section of fabric 10 in the direction of the entrance to heated stuffing chamber 80.

The reciprocating, pushing action of members 60, by acting on the previously pleated but uncreased fabric and forcing the fabric 10 into a wadded, tightly packed mass within chamber 80, causes a random-appearing network of creases in fabric 10 to form which are of various lengths and degrees of definition. These creases are then heat set by the relatively slow passage of the wadded mass of fabric through heated stuffing chamber 80. In the embodiment shown, the passage of the wadded mass of fabric 10 through chamber 80 is brought about by the stuffing action of members 60; no independent conveying means is necessary. Therefore, the action of members 60 may be said to perform at least three functions: (1) imparting a series of folds in the fabric in directions different from the folds imparted by pleating means 20; (2) imparting the random-appearing network of creases to the folded fabric by tightly compacting the fabric into heated stuffing chamber 80; and (3) pushing the resulting wadded mass of fabric through chamber 80 at the desired rate.

Machinery which incorporates a pleating device and a feeding device which may be used in the practice of this invention is marketed commercially under the name POLROTOR CRUSHER Model PCR 180, by Polrotor, Inc. of North Amityville, N. Y. This machinery is believed to be generally used to impart a crushed pile appearance to pile fabrics which have been previously dyed.

In a preferred embodiment of this invention, the interior of chamber 80 is constructed of a relatively smooth, low friction material, such as tetrafluoroethylene. The shape of the chamber interior is that of a rectangular solid having a width approximately equal to the width of the array of members 60, a height which is somewhat less than the length of the folds imparted by the action of members 60 (i.e., somewhat less than the length of the stroke of members 60, as reflected onto bottom plate 66), and a length sufficient to ensure the desired heating of, and heat distribution within, the mass of wadded fabric inside chamber 80. Of course, tunnel volume may be adjusted to suit the quantity of fabric being processed. It is not unusual to have 200 yards or more of sixty-two inch wide fabric wadded into the confines of a stuffing chamber having interior dimensions of about 28 inches wide, by about 2 inches high, by about 108 inches long. It has been found that in processing certain fabrics, e.g., woven or knitted flat fabrics having a weight of less than about 1.8 oz./yd.$^2$, it may be advantageous to incline the roof of the stuffihg chamber at a slight angle to form a slightly increasing cross-sectional chamber area in the direction of fabric movement. Abrupt increases in such area, e.g., by sharply raising the roof of the stuffing chamber by 10–20% or more near the exit portion of chamber 80, may also prove helpful. Tunnel temperatures within the range of 350° to about 410° F., generally uniformly maintained along the length of the tunnel, and tunnel residence times of 50 to 80 minutes or more (tunnel residence time is the total time a given wadded mass of fabric is inside the tunnel), have been used on various fabrics containing 100% polyester as well as 100% acrylic. It is expected that fabrics containing other materials, or perhaps 100% polyester or acrylic fabrics of different constructions, may require temperature and/or tunnel residence times different from those recited above. See the Examples hereinbelow for details of particular operating conditions and specifications, among others, which may be used in practicing this invention.

Figure 11:
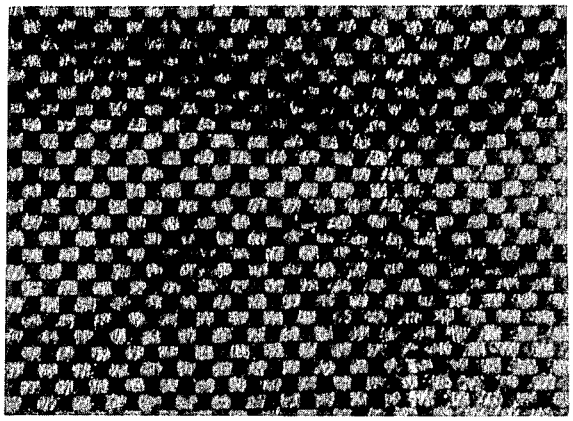
FIG. 11 is a reflected light photomicrograph (10x) of a crease shown in FIG. 9.
Figure 12:
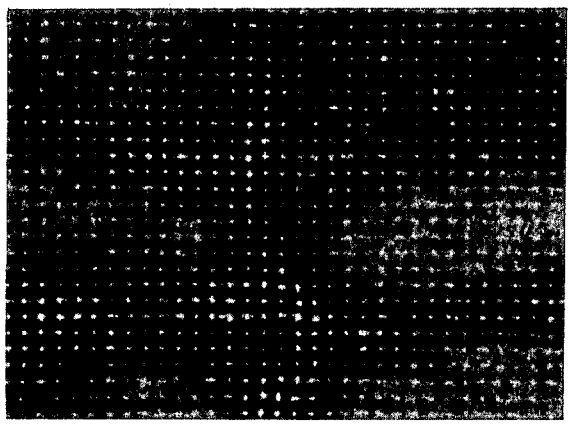
FIG. 12 is a transmitted light photomicrograph (10x) of a crease shown in FIG. 10.
Figure 13:
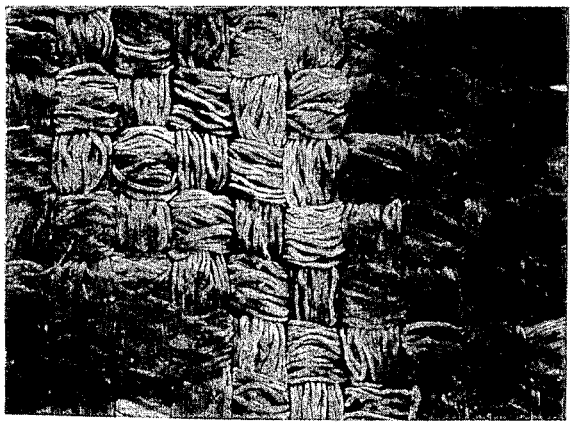
FIG. 13 is a scanning electron photomicrograph (45x) of a crease similar to that shown in FIG. 9.

The textile product produced by the process disclosed herein may be identified by a pattern of nodes and interconnecting line segments which coincide with creases formed when the calendered fabric is compressed within chamber 80, and which form a random-appearing pattern or network on the fabric surface. In the case of flat fabric, the fabric is preferably comprised of heat-settable yarns which in turn are comprised of bundles of individual textile filaments. The random-appearing pattern is defined by areas on the fabric surface wherein at least some adjacent individual filaments within yarn segments forming the face of said fabric have been separated from one another, thereby substantially increasing the interstitial spacing between said filaments in comparison with filaments in yarn segments in the remaining, crease free portions of the calendered fabric surface which comprise the pattern-complementary areas. This may be seen in FIGS. 11 and 13. Such an increase in the inter-filament spacing within individual yarns nearest the surface is though to enhance selectively the speed and degree of penetration of dye or other fluid applied to the fabric in those areas in which such filament separation has taken place, in comparison with the remaining, pattern-complementary areas where the calendering treatment has resulted in yarns wherein the filaments are tightly pressed together and present a relatively impervious surface, as best seen in FIG. 13. It is believed this results in an increase in the dye take-up in the pattern areas, and causes such areas generally to exhibit more visually saturated color. Thus a single conventional dyeing step, applied to fabric treated in accordance with this invention, results in a multi-tone effect, with a visually darker or more color saturated network of lines and nodes superimposed upon a background of a visually lighter or less color saturated color shade generated by the same dye. This selective penetration enhancement appears to remain, although to a lesser degree, when the creased fabric is stretched in a tenter frame under conditions of heat sufficient to "set" the fabric in a relatively crease-free condition, thereby allowing the patterning of a fabric by dyeing the fabric after the fabric has been made substantially smooth and uncreased. For maximum patterning effect, however, it is preferred that the creased fabric be dyed (or otherwise applied with a fluid patterning agent) prior to any crease-removing treatment which may be deemed desirable.

It is also thought that the physical break-up of the calendered surface into multiple planes, as well as the relative separation of yarns and/or constituent filaments, tends to present the creased areas as visually darker or having more saturated color due to a "light trapping" effect, even without an actual increase in dye take-up in such areas.

Figure 9:
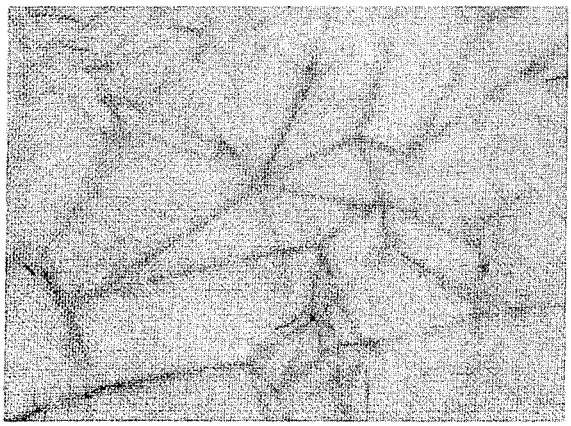
FIG. 9 is a reflected light photomicrograph (1.9x) of a woven polyester fabric which has been processed in accordance with the teachings herein.
Figure 10:
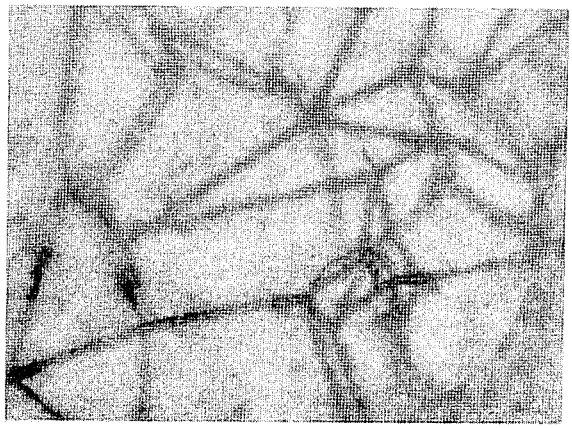
FIG. 10 is a transmitted light photomicrograph (1.9x) of the fabric of FIG. 9.
Figure 15:
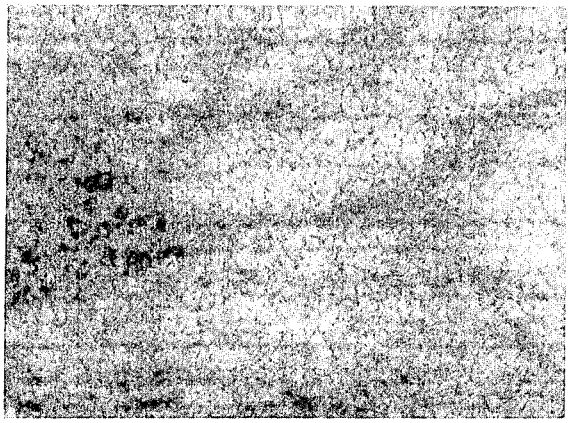
FIG. 15 is a reflected light photomicrograph (1.9x) of a pile fabric processed in accordance with the teachings of the invention disclosed herein.
Figure 16:
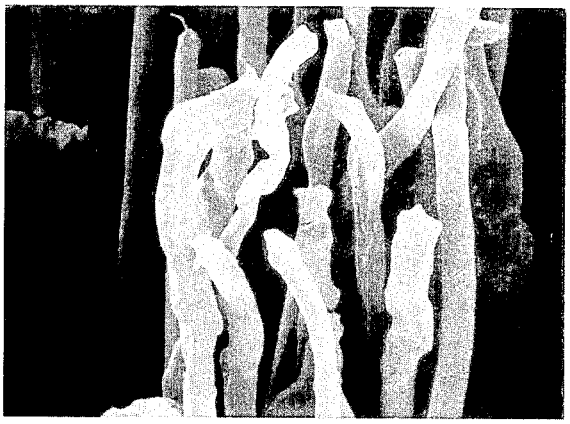
FIG. 16 is a scanning electron photomicrograph (350x) of a darkly patterned area of the fabric of FIG. 14.
Figure 17:
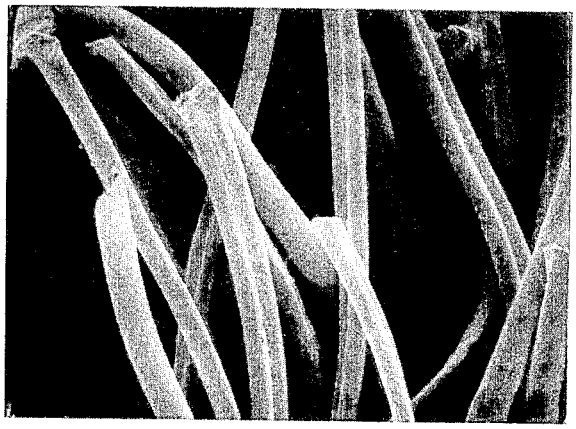
FIG. 17 is a scanning electron photomicrograph (350x) of an untreated fabric of similar construction.

The pattern itself generally takes the form of a series of "nodes" and line segments. The term "node" as used herein is meant to mean the point at which two or more line segments meet and at which at least one such line segment ends. A line segment which abruptly "changes direction" is considered to be a different line segment. The line segments are non-uniform in terms of length, relative direction, and degree of definition, and most are arranged on the fabric surface in groups of three or more which appear to radiate from one or another of a plurality of nodes which are distributed over the fabric surface at non-uniform locations. Most of the line segments connect two such nodes. The result is a network of interconnected nodes and line segments similar to that shown in FIGS. 9 and 10.

Where a 100% polyester or acrylic pile fabric is treated in accordance with the teachings of this invention and then brushed or otherwise treated to raise the flattened pile, it is observed that an irregular network of lines and shaded areas, similar to that depicted in FIG. 15, is produced. The individual pile elements in areas defining the relatively dark lines appear twisted, crimped, or otherwise distorted without substantial shrinkage, as is depicted in FIG. 16. A photomicrograph of an untreated fabric of similar construction is shown in FIG. 17. The pile fabric is first calendered under conditions of relatively high temperature and pressure (see Example 5), which conditions are sufficient to flatten the individual pile elements on the fabric and form a stiff crust on the fabric surface. Passage of this stiffened, crust-bearing fabric through the pleating and stuffing procedures described hereinabove results in a fabric which retains patches or plates of stiff crust within an irregular network of lines forming the edges of the crust plates. Upon dyeing, it is believed dye seeps more readily into the fabric, and therefore tends to concentrate, in the vicinity of breaks in the crust (i.e., the crust plate edges), compared with the areas where the crust remains intact. This causes the formation of a pattern of relatively darkly dyed nodes and line segments on the face of the finished pile fabric which coincides with the crust plate edges, as seen against a relatively lightly dyed background.

The following is a series of Examples intended to demonstrate several embodiments of the invention disclosed herein. These Examples are exemplary only, and are not intended to be limiting in any way.

EXAMPLE 1

A web of 100% woven polyester fabric having a weight of 2.0 oz. per square yard and a width of sixty inches is calendered at a web speed of ten yards per minute, a roll force of eighty tons, and a roll temperature (single roll) of 425° F. The calendered fabric is then processed in a device similar to that depicted in FIG. 2. The pleated fabric is fed into a heated chamber having the dimensions disclosed hereinabove; feeding parameters (e.g., stroke length and stroke frequency of pushing fingers) are adjusted to pack approximately 200 linear yards of fabric into chamber 80, with a residence time of about 60 minutes. The chamber is heated to a temperature of 415° F. Upon exiting chamber 80, the fabric is wound onto a roll for transportation to a dyeing and finishing operation, where the fabric is jet dyed under routine dyeing conditions using a medium blue dye, and finished using standard mill procedures. The resulting fabric is that depicted in FIGS. 9–13. The creased fabric exhibits a random-appearing dyed network of nodes connected by line segments which corresponds to the creases imparted to the fabric. The nodes appear to be distributed over the fabric surface in random locations and appear against a background which is noticeably visually lighter. Most nodes have three or more line segments, having non-uniform length, relative direction, and degree of definition, which appear to emanate or terminate at the node. Most line segments are less than about three inches long. Substantially all line segments are less than about six inches long.

EXAMPLE 2

Figure 14:
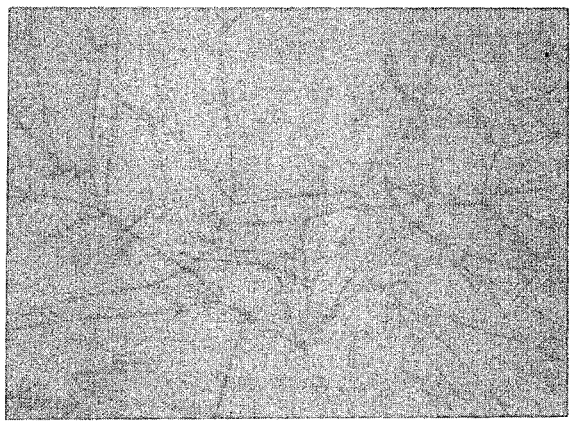
FIG. 14 is a transmitted light photomicrograph (1.2x) of a woven polyester fabric which has been calendered, processed in accordance with the teachings herein, dyed, then stretched under conditions of heat.

The fabric product of the process of Example 1 is placed on a tenter frame and stretched flat for a period of approximately one minute while being heated to about 370° F. The creases in the fabric are substantially completely removed, leaving the dyed network of nodes and line segments seen in the fabric of Example 1, without the creases associated therewith as depicted in FIG. 14.

EXAMPLE 3

The fabric of Example 1 is processed according to the procedures of Example 1, except that the fabric is placed on a tenter frame and stretched flat for a period of several minutes, while being heated to about 415° F., prior to being jet dyed and finished. The creases in the fabric are substantially completely removed prior to the dyeing and finishing procedures. The resulting fabric exhibits the same dyed pattern as in Example 2, except the pattern contrast relative to the background is somewhat reduced when compared with the fabric of Example 2.

EXAMPLE 4

A woven fabric comprised of a 65% polyester and 35% cotton blend (by weight) is calendered and processed using the procedures of Example 1. The resulting product exhibits a network of dyed, creased line similar to those imparted to the fabric in Example 1.

EXAMPLE 5

A web of 100% acrylic pile fabric having a weight of 4 oz. per square yard and a width of sixty inches is calendered at a web speed of eight yards per minute at a roll pressure of seventy-five tons, and a roll temperature (single roll, on face) of 425° F. The calendered fabric is then processed as in Example 1, except that approximately 150 yards of fabric is packed into chamber 80. Residence time and chamber temperature are as in Example 1. The processed fabric wound onto a roll for transportation to a dyeing and finishing operation, where the fabric is range dyed and finished using standard mill procedures, including standard brushing. The resulting fabric is substantially crease-free, and has the appearance of the fabric of FIG. 15, with a dyed pattern similar in structure to the pattern obtained in Example 1.

I claim:

1. A method for imparting a pattern of nodes and interconnecting line segments having a random appearance to a moving web of textile fabric comprising synthetic yarns and having a relatively hard calendered surface comprising the steps of:

(a) introducing pleats into said calendered fabric in a warp direction;

(b) introducing folds into said pleated fabric, which folds extend in a transverse direction relative to said pleats;

(c) wadding said pleated and folded fabric into a confined space in a manner which creates random-appearing creases in said fabric; and (d) heating said wadded and creased fabric in said confined space under conditions sufficient to heat set said creases in said fabric while moving said fabric through said confined space.

2. The product of the process of claim 1.

3. The method of claim 1 wherein said wadded fabric is allowed to cool, following said heating step, after which said fabric is dyed.

4. The product of the process of claim 3.

5. The method of claim 3 wherein following said dyeing step said fabric is stretched and heated to a tempereature sufficient to heat set said fabric to remove permanently at least some of said creases in said fabric.

6. The product of the process of claim 5.

7. The method of claim 1, comprising the additional steps of stretching and heating said fabric carrying said heat set creases under conditions sufficient to remove permanently at least some of said creases prior to a dyeing step, and dyeing said fabric following said stretching step.

8. A flat, dye textile fabric having a calendered surface comprised of heat-settable fibers, said calendered surface being dyed and carrying a pattern thereon, said pattern comprised of a plurality of nodes and line segments, said line segments having substantially different lengths, directions, and degrees of sharpness and/or thickness, most of said line segments emanating or terminating in groups of at least three at one or another of said nodes, which nodes are non-uniformly distributed over said fabric surface, forming thereby a substantially interconnected dyed network of nodes and line segments which appear on a contrasting background of calendered fabric, said network and said background having been dyed with the same dye.

9. The fabric of claim 8 wherein said dyed network corresponds to a network of creases in said fabric.

10. The fabric of claim 8 wherein most of said line segments are less than about three inches in length.

11. The fabric of claim 8 wherein substantially all of said line segments are less than about six inches in length.

12. The fabric of claim 9 wherein said line segments are comprised of portions of said fabric wherein the interstitial spacing of the filaments comprising the yarns in the area of said line segments has been substantially increased relative to those areas of the fabric forming said background.

13. A heat settable textile fabric dyed with a single color dye having a fae comprised of synthetic pile fibers, at least some of which have a somewhat flattened cross section and which have been crimped irregularly along their length, said fabric carrying a dyed pattern comprising a plurality of nodes and line segments, said line segments having substantailly different lengths, directions, and degrees of sharpness and/or thickness, most of said line segments emanating or terminating in groups of at least three at one or another of said nodes, which nodes are non-uniformly distributed over said fabric surface, forming thereby a substantially interconnected network of nodes and line segments which appear on a contrasting background of pile fabric, said background containing a substantially lower concentration of said dye than is found in said nodes and line segments.

* * * * *